United States Patent [19]

Figueroa

[11] 4,234,238

[45] Nov. 18, 1980

[54] FILE SUPPORT STRUCTURE FOR DRAWER

[76] Inventor: Ruben Figueroa, 75 E. 13 St., Hialeah, Fla. 33010

[21] Appl. No.: 31,184

[22] Filed: Apr. 18, 1979

[51] Int. Cl.[3] ..... A47B 63/00

[52] U.S. Cl. ..... 312/184; 312/183; 312/185

[58] Field of Search ..... 312/184, 341 NR, 183, 312/185; 402/502

[56] References Cited

U.S. PATENT DOCUMENTS

| | | | |
|---|---|---|---|
| 2,937,765 | 5/1960 | Shank | 312/341 NR |
| 3,281,193 | 10/1966 | Murray | 312/184 |
| 3,365,259 | 1/1968 | Heisman et al. | 312/184 X |
| 3,456,994 | 7/1969 | Sullivan | 312/184 X |
| 3,850,488 | 11/1974 | Elias | 312/184 |
| 3,938,870 | 2/1976 | Guest | 312/184 |
| 4,138,176 | 2/1979 | Coworoy | 312/341 NR |

FOREIGN PATENT DOCUMENTS

| | | | |
|---|---|---|---|
| 1446425 | 6/1966 | France | 312/184 |

*Primary Examiner*—James T. McCall

[57] ABSTRACT

A file support for file folders for use in converting storage drawers to a file drawer which is composed of a first pair of channel form track members to nest over the sidewalls of a drawer between the inside surface of the front drawer panel and the outside surface of the rear drawer panel, which rear drawer panel is somewhat shorter than the sidewalls to accommodate the same. The track members include an upstanding flange defining a depthwise pair of tracks for hooked-up engagement with the file support suspended in spanning relation of the drawer sidewalls. In an alternative, the support members are supported in spanning relation of the sidewalls on tracks which in turn are supported on four clip members, each of which are of channel form to nest over the sidewalls in spaced relation from one another and each of which has an inwardly extending projection sized to support a second pair of channel form members spanning the sidewalls, each with an upstanding flange defining a lateral pair of tracks for hooked-up engagement with file support suspended in spanning relation between the track members supported by the clip form adapters. The clips have an upstanding ear to act as a stop to limit lateral movement of the files to keep them in sliding engagement with the lateral tracks when in the alternative embodiment.

10 Claims, 7 Drawing Figures

FILE SUPPORT STRUCTURE FOR DRAWER

FIELD OF THE INVENTION

This invention relates to drawers of furniture and, more particularly, to a means for converting storage drawers especially in desks, into file drawers.

BACKGROUND OF THE INVENTION

Quite often in desks and bureaus it is desirable to have storage space for files; however, it is often difficult to convert such drawers so that the same are adapted to hold a number of files in neat orderly arrangement, such as typifies file cabinets. This invention is of a support for converting the storage portion of a drawer in such a manner that it will accommodate files.

OBJECTS OF THE INVENTION

It is an object of this invention to provide a support structure for file folders which is adapted for use in converting the storage space within drawers into a space for an orderly arrangement of files which may be suspended in file support folders which in turn are in hooked-up engagement for sliding movement along the tracks. The support includes a pair of guide tracks each being of channel form sized for nesting over opposing sides of the drawer and which guide tracks have an upstanding flange extending continuously along the length thereof for hooked-up engagement with downwardly opening hooks on opposite sides of conventional file support folders.

It is an object of this invention to provide a support as set forth in the preceding paragraph which includes a plurality of adjustable adapters in the form of clips with a body of channel form which may be adjusted along the side walls of a drawer so that, the same may be spanned by a pair of guide tracks, each guide track having an upstanding flange for hooked-up engagement with a file support folder and wherein the body includes a track support projection to extend into the drawer and in upstanding relation on the body and ear to act as a stop means to limit sliding movement of file folders along the tracks when laterally arranged across the sidewalls of a drawer.

In accordance with these and other objects which will become apparent hereinafter the instant invention will now be described with reference to the accompanying drawings in which:

DETAILED DESCRIPTION OF THE PREFERRED EMBODIMENT

Figure 1:
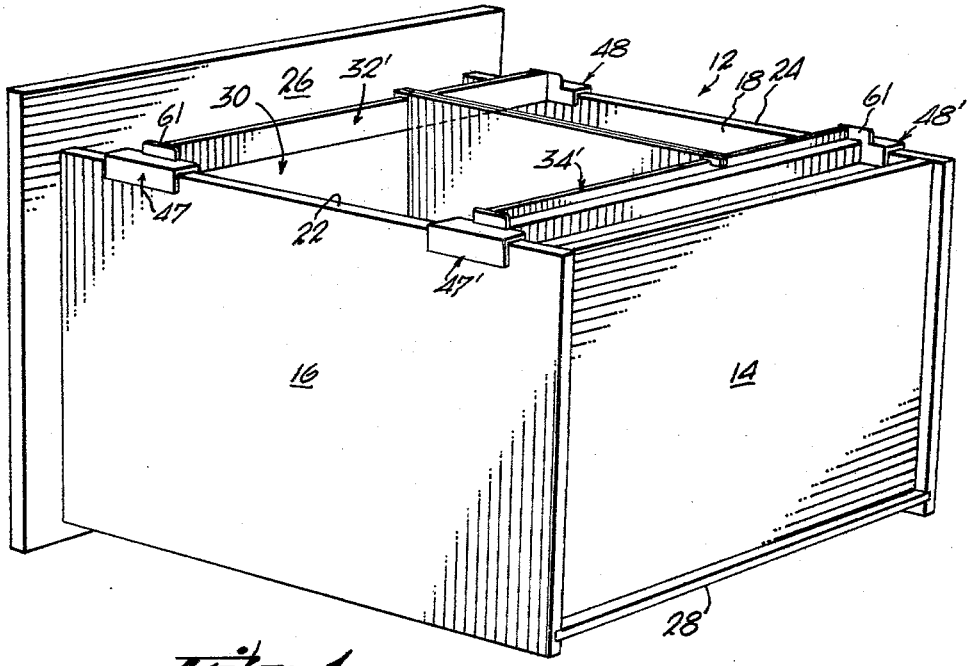
FIG. 1 is a perspective view of a drawer provided with a first adjustable embodiment of the instant invention.

Referring to the drawings wherein like reference characters designate like or corresponding parts throughout the several views, the numeral 12 generally designates a drawer of a desk or bureau which includes side walls 16 and 18, each having an upper terminal edge 22 and 24 in a common horizontal plane which together with a front drawer panel 26, rear drawer panel 14 and floor 28 define a drawer receptacle 30. The rear panel in a preferred embodiment has a somewhat lower upper edge 20 for a purpose to be described hereinafter.

Figure 2:
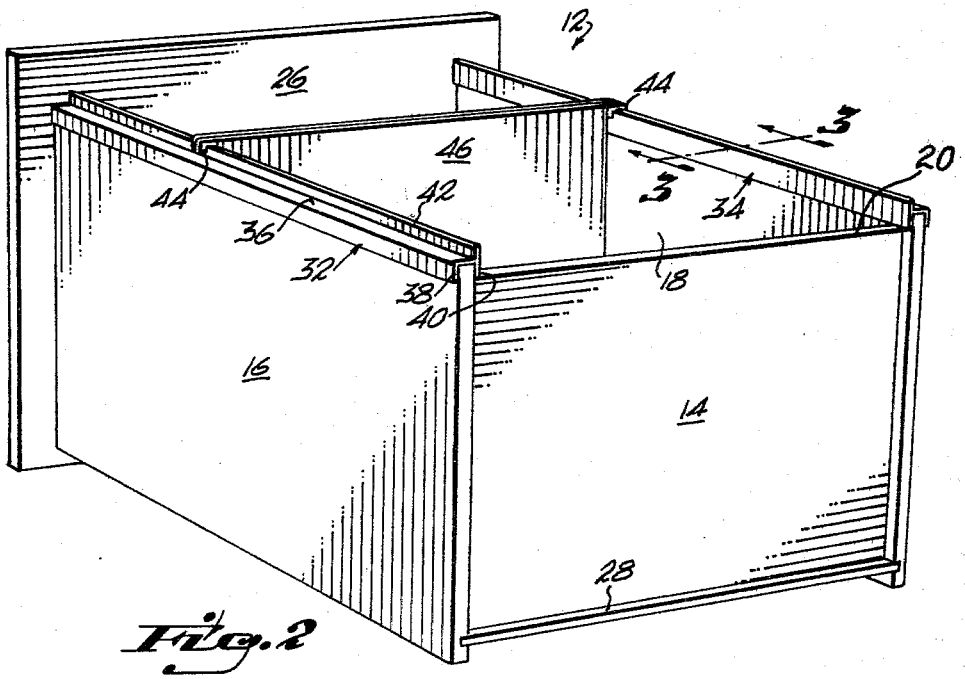
FIG. 2 is a perspective view of a drawer provided with an alternative embodiment of the instant invention.
Figure 3:
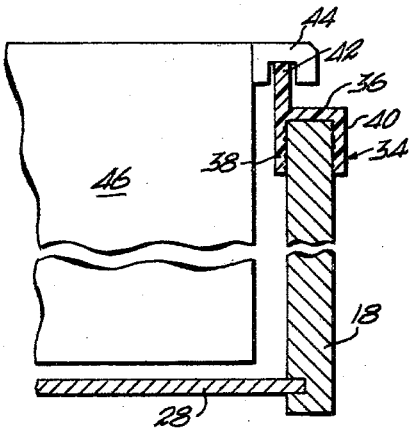
FIG. 3 is a view in cross section taken on the plane indicated by the line 3—3 of FIG. 2 and looking in the direction of the arrows.
Figure 5:
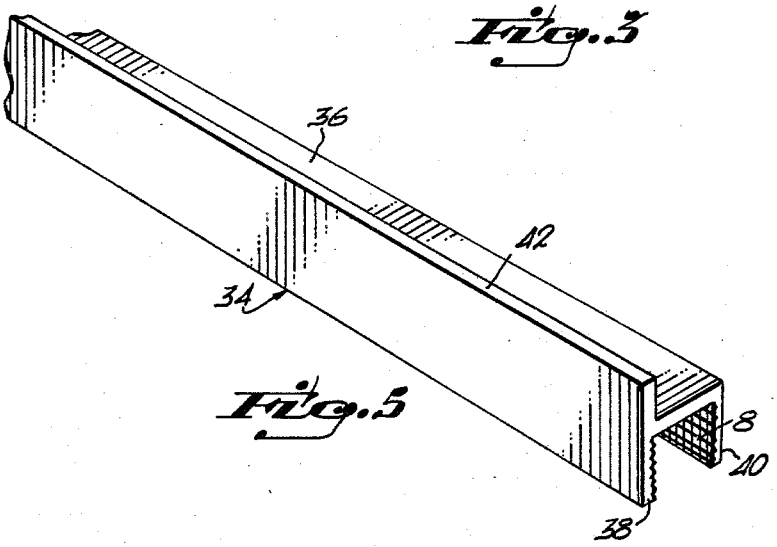
FIG. 5 is a perspective view of one of the guide tracks included in the embodiment of FIGS. 1 and 2.
Figure 7:
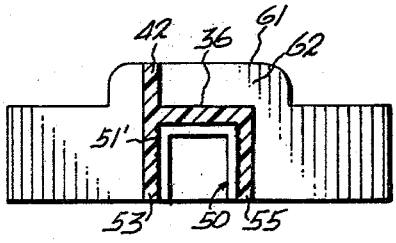
FIG. 7 is a view in cross section taken on the plane indicated by the line 7—7 of FIG. 6.
Figure 6:
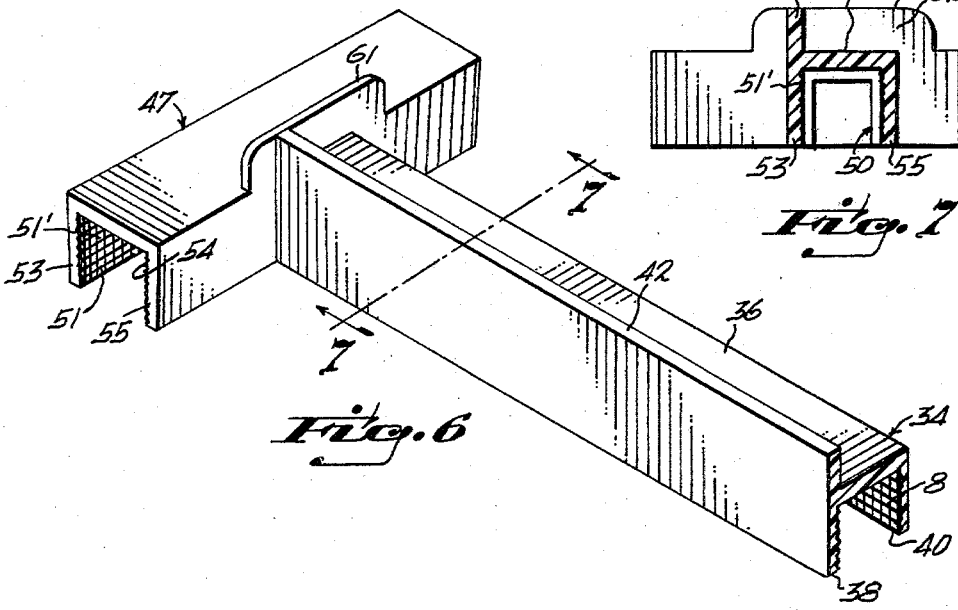
FIG. 6 is a partial perspective view illustrating a guide track in connecting relation to an adjustable adapter of the embodiment shown in FIG. 1.

Referring to FIG. 2, in which similar numbers designate the drawer portions described above, a preferred embodiment of the file support structure is illustrated, the same being composed of two guide tracks 32 and 34, one of which, 34, is illustrated in FIGS. 3 and 5. Each of the tracks is of uniform cross section and is of extruded plastic material in the rigid range, preferably, polyvinyl chloride. The tracks are of channel form and of a length substantially equal to the top edge of the drawer sidewalls between the inside surface of the front panel and the outside or exterior surface of the rear wall. The web 36 of the guide tracks 32 and 34 respectively overlays the upper sidewall edge surfaces and the legs 38 and 40 nest in overlaying relation about the upper margins of the sidewalls. Preferably, the legs converge toward one another at a shallow angle toward their terminal or outer distal ends to define a clamping action due to the plastic memory of the material and, additionally, the inside or confronting surfaces of the legs or flanges may be provided with gripper teeth in the form of ridges 8 which are provided to resist inadvertent removal of the tracks from the illustrated position shown in FIG. 2. An upstanding rail designated by the numeral 42 is provided on the web of each track for hooked-up engagement with the support hooks 44 of a file support folder 46.

The tracks may be of extruded plastic or metal material and are somewhat thinner than illustrated so as not to substantially interfere with the drawer suspension. There is thus provided a means which is inexpensive and readily installed and which is especially useful to convert a storage drawer into a file drawer. It is seen that the lengths of the tracks are such that the ends fit snugly against the inside surface of the front panel and that the opposite end overlays the rear panel upper surface to define a continuous track. Also, the somewhat lower upper surface of the rear wall accommodates a longer track which extends beyond the inside surface of the rear panel to the outside surface so that the inside surface acts as a file stop to limit sliding movement of the file holders therealong.

Figure 4:
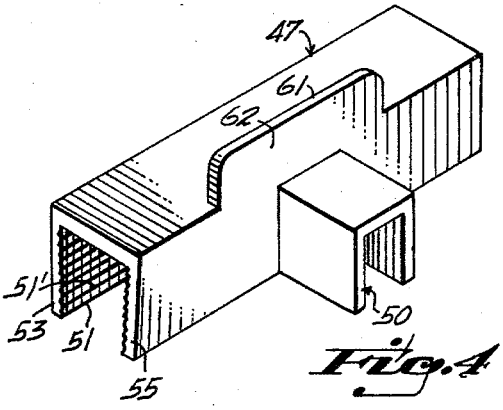
FIG. 4 is a perspective view of an adjustable adapter included in the support structure for the embodiment of FIG. 1.

The embodiment shown in FIG. 1 differs from that shown in FIG. 2 in that the files are to be arranged in side-to-side alignment rather than the front-to-rear alignment of FIG. 2. In this embodiment, the support is adjustable as to size in that the forward track 32' is adjustable toward or away from the associated rear track 34', as will now be explained. The forward or rearward tracks 32' and 34' are supported at their respective ends by adapters 47 and 48, and 47' and 48'. The adapters are best seen in FIG. 4. Each is of channel form and nests in opposing relation to a similar adapter over the top edge of the drawer side walls. Each of the channel form adapters includes a relatively short laterally extending leg, such as 50, of a dimension such that the channel of the tracks described above is adapted to nest over the leg and to be supported at its ends thereby, as is shown. The adapters are adjustable along the drawer sidewalls to vary the file size, for example, to accommodate legal or letter size file holders. The interior surface of the channel portions of the adapters as indicated by the numeral 51 and 54 may have gripper edges or ridges 51' as described above. The distance between the legs 53 and 55 is sized to nest over the upper edge of the drawer. Means to fix them in the adjusted position relative to the sidewalls may be provided, such as by adhesive means or a fastener which extends through a hole in one of the channel legs to accommodate a stay pin pin or tack. On the outside surface of each of the adapter bodies, an upstanding ear 61 is provided, see FIG. 4, which extends along the web on opposite sides of the leg 50 and adjacent the surface 62 and against which the end of the tracks abut so that in sliding movement, the same do not easily fall off the track and out of sliding engagement with it.

While the instant invention has been shown and described in what is considered to be a practical and preferred embodiment, it is recognized that departures may be made therefrom within the spirit and scope of the claims which follow and which are therefore not to be limited except within the doctrine of equivalents.

What is claimed is:

1. A file support structure for use on drawers of a type having front, rear, and side panels, the rear and side panels having generally common thickness, each panel having an upper terminal edge and the edges in generally common plane, the structure comprising:

the combination of a pair of guide tracks and a first and second adjustable channel adapter pairs, each adapter comprising a channel including a middle portion defining a web and downwardly extending legs adapted for abutting engagement with the side panel terminal edge, the channel including a middle inner portion having an inwardly extending channel and an upper portion defining an ear stop means for limiting movement adjacent the inwardly extending middle portion, each guide track comprising a channel of predetermined length with a middle portion defining a web and downwardly extending legs adapted for connection with the inwardly extending middle portion of the channel adapter, the track including an upwardly extending flange defining a rail along the track for hooked-up connection with the file, each pair of adapters adapted for opposed connection on either side of the side panel terminal edge and the pairs spaced apart a predetermined common distance, and the guide tracks adapted for spanning a respective pair of adapters.

2. A file support structure for use on drawers of a type having front, rear, and side panels, the rear and side panels having generally common thickness, each panel having an upper terminal edge and the edges in generally common plane, the structure comprising:

a pair of guide tracks, each guide track having a middle portion comprising a web and a pair of downwardly extending legs, extending downwardly a predetermined common distance from the web, each leg being of uniform cross section and thickness, the legs converging toward one another with one leg being angled slightly more than the other, the legs including an inside surface having longitudinally extending gripper means extending generally throughout the length of the leg comprising rib means, each guide track including an upstanding flange extending along the length of the track for hooked-up engagement with the file, and the rear panel of the drawer being of a smaller height than the remaining panels defining a stop means for limiting movement of the file.

3. The device as set forth in claim 2 wherein each guide track comprises:

a middle portion comprising a web and a pair of downwardly extending legs, extending downwardly a predetermined common distance from the web, each leg being of uniform cross section and thickness, the legs converging toward one another with one leg being angled slightly more than the other, the legs including an inside surface having longitudinally extending gripper means extending generally throughout the length of the leg comprising rib means, each guide track including an upstanding flange extending along the length of the track for hooked-up engagement with the file, and the rear panel of the drawer being of a smaller height than the remaining panels defining a stop means for limiting movement of the file.

4. The device as set forth in claim 3 wherein the track legs are made of metal.

5. The device as set forth in claim 4 wherein the legs are made of a rigid material.

6. The device as set forth in claim 1 wherein the adapters and the guide track legs are made of a rigid but still flexible material having an elastic memory.

7. The device as set forth in claim 6 wherein the legs of the adapter are converging.

8. The device as set forth in claim 7 wherein the legs of the adapter have an inside surface with a rib forming a rib means defining a gripper means.

9. The device as set forth in claim 8 wherein the adapters and guide tracks are made of nylon.

10. The device as set forth in claim 1 or claim 2 wherein the guide track and/or adapters are connected to their respective channels with their respective webs in abutting engagement with the terminal edge of said panels and the file support structure is in a position for use.

* * * * *